US007954635B2

(12) United States Patent
Biondi et al.

(10) Patent No.: US 7,954,635 B2
(45) Date of Patent: Jun. 7, 2011

(54) PACKAGE OF CIGARETTES

(75) Inventors: Andrea Biondi, Bologna (IT); Ivanoe Bertuzzi, Casalecchio Di Reno (IT); Roberto Polloni, Modigliana (IT); Michele Squarzoni, Ferrara (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 12/667,432

(22) PCT Filed: May 13, 2008

(86) PCT No.: PCT/IB2008/001257

§ 371 (c)(1),
(2), (4) Date: Jun. 11, 2010

(87) PCT Pub. No.: WO2009/004421

PCT Pub. Date: Jan. 8, 2009

(65) Prior Publication Data

US 2010/0276311 A1 Nov. 4, 2010

(30) Foreign Application Priority Data

Jul. 2, 2007 (IT) ..... BO2007A0456

(51) Int. Cl.
*B65D 85/10* (2006.01)

(52) U.S. Cl. ..... 206/252; 206/817

(58) Field of Classification Search ..... 206/252, 206/266, 255, 265, 271, 273, 817
See application file for complete search history.

(56) References Cited

U.S. PATENT DOCUMENTS

| | | | | | |
|---|---|---|---|---|---|
| 1,790,370 | A | | 1/1931 | Earman | |
| 1,806,905 | A | * | 5/1931 | Kampfman | 206/252 |
| 1,864,871 | A | | 6/1932 | Straus | |
| 1,994,540 | A | * | 3/1935 | Spiking | 206/273 |
| 2,185,605 | A | * | 1/1940 | Murphy et al. | 206/252 |
| 2,331,035 | A | * | 10/1943 | Lundstrom | 206/252 |
| 2,510,630 | A | * | 6/1950 | Goldsworthy | 206/252 |
| 2,688,434 | A | * | 9/1954 | Udel | 206/264 |
| 3,119,517 | A | * | 1/1964 | Adams | 221/87 |
| 3,446,338 | A | * | 5/1969 | Bozyk | 206/250 |
| 5,058,739 | A | * | 10/1991 | Sainsbury | 206/252 |
| 6,450,329 | B1 | * | 9/2002 | Draghetti et al. | 206/252 |
| 7,066,324 | B2 | * | 6/2006 | Yin et al. | 206/254 |
| 7,721,881 | B2 | * | 5/2010 | He | 206/249 |

FOREIGN PATENT DOCUMENTS

| | | | |
|---|---|---|---|
| DE | 19851201 | A1 | 1/2000 |
| GB | 311957 | A | 5/1929 |
| WO | WO-9849072 | A1 | 11/1998 |
| WO | WO-2004074123 | A1 | 9/2004 |

OTHER PUBLICATIONS

International Search Report in PCT/IB2008/001257 dated Jan. 13, 2009.

* cited by examiner

*Primary Examiner* — Jacob K Ackun, Jr.
(74) *Attorney, Agent, or Firm* — Marshall, Gerstein & Borun LLP

(57) ABSTRACT

A package of cigarettes having a group (4) of cigarettes; an inner package (3) which encloses the group (4) of cigarettes, is defined by a sheet (22) of transparent, heat-seal plastic packing material folded directly about the group (4) of cigarettes and in direct contact with the cigarettes, and is stabilized by heat sealing; and a U-shaped stiffener (23) of rigid material located inside the inner package (3) and contacting the group (4) of cigarettes.

18 Claims, 8 Drawing Sheets

PACKAGE OF CIGARETTES

CROSS-REFERENCE TO RELATED APPLICATIONS

This application is the U.S. national phase of International Application No. PCT/IB2008/001257, filed May 13, 2008, which claims the benefit of Italian Patent Application No. BO 2007A000456, filed Jul. 2, 2007.

TECHNICAL FIELD

The present invention relates to a package of cigarettes with an inner package fitted with a cover flap.

In the following description, reference is made, for the sake of simplicity, to a rigid, hinged-lid packet of cigarettes, purely by way of a non-limiting example.

BACKGROUND ART

Rigid, hinged-lid packets of cigarettes are currently the most widely marketed, by being easy to produce, practical and easy to use, and by effectively protecting the cigarettes inside.

A rigid, hinged-lid packet of cigarettes comprises an inner package defined by a group of cigarettes wrapped in a sheet of inner foil packing material; and a rigid outer package housing the inner package. The outer package comprises a cup-shaped container housing the group of cigarettes and having an open top end; and a cup-shaped lid hinged to the container along a hinge to rotate, with respect to the container, between an open and a closed position opening and closing the open end respectively. A U-folded collar is normally fitted inside the container, and projects partly outwards of the open end to engage a corresponding inner surface of the lid when the lid is in the closed position.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, packets of cigarettes are therefore cellophane-wrapped, i.e. wrapped in a heat-sealed overwrapping of airtight plastic material. This, however, may not always be sufficient to fully preserve the tobacco in the packet, especially if the packet is consumed some time after manufacture. Moreover, when the packet is unsealed, the overwrapping is removed, thus exposing the tobacco to the atmosphere, and, if the cigarettes are not consumed soon after the packet is unsealed, the organic characteristics of the remaining cigarettes may deteriorate visibly.

In an attempt to eliminate this drawback, rigid packets of cigarettes have been proposed, in which the inner package is heat sealed airtight, and comprises a sheet of airtight inner packing material having a cigarette extraction opening closed by a reusable cover flap. In other words, the cover flap has fastening means (e.g. a strip of non-dry re-stick adhesive) by which to repeatedly secure the cover flap in a closed position closing the cigarette extraction opening.

One problem of rigid packets of cigarettes, in which the inner package comprises a sheet of airtight packing material with a cigarette extraction opening, is that, once some of the cigarettes are removed, the inner package tends to collapse, thus making it difficult to withdraw the remaining cigarettes, and, in particular, to open and close the cover flap. Moreover, when heat sealing the superimposed portions of the sheet of airtight inner packing material, the cigarettes are subjected to mechanical stress that may result in local deformation and/or tobacco fallout, and to thermal stress possibly resulting in local deterioration of the tobacco.

By way of a solution to the problem, it has been proposed to insert a rigid collar, in the form of a cardboard strengthener, inside the inner package and about the group of cigarettes to maintain the shape of the inner package and protect the cigarettes when folding and heat sealing the sheet of airtight inner packing material. However, placing and folding the rigid collar about the group of cigarettes before folding the sheet of inner packing material about the group is extremely complicated on a standard packing machine; which means this type of packet calls for a special packing machine that is much more expensive than an equivalent standard type.

Moreover, the sheets of airtight inner packing material currently used to produce airtight inner packages are made of multilayer packing material comprising at least one foil inner layer and an outer layer of heat-seal plastic. As a result, they are thick and stiff and therefore difficult to fold, and fail to faithfully reproduce the outer contour of the group of cigarettes (i.e. fail to form square edges), thus resulting in "convex" airtight inner packages that are normally unpopular with users.

GB311957A and U.S. Pat. No. 1,790,370 A1 disclose a package of cigarettes comprising an outer pouch-like case open at one end and an inner drawer slidable therein and containing the cigarettes which are wrapped in air and moisture proof material.

DISCLOSURE OF THE INVENTION

It is an object of the present invention to provide a package of cigarettes designed to eliminate the aforementioned drawbacks, and which at the same time is cheap and easy to produce.

According to the present invention, there is provided a package of cigarettes as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 3:
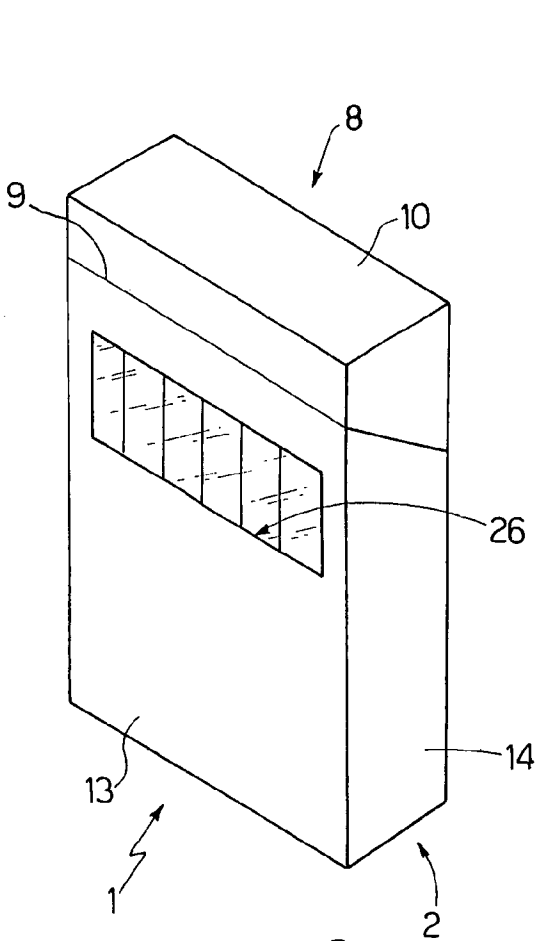
FIG. 3 shows a rear view in perspective of the FIG. 1 packet of cigarettes in a closed configuration.
Figure 2:
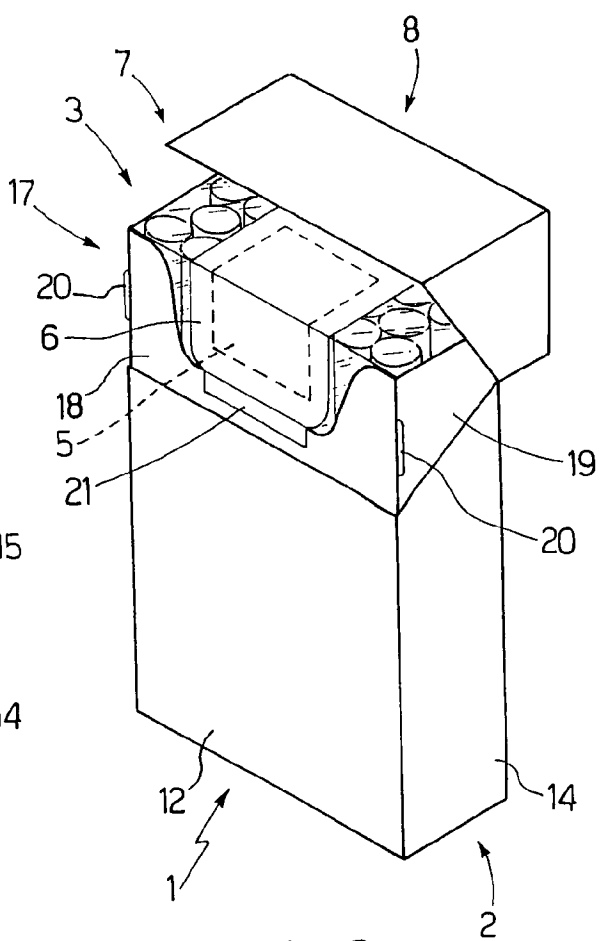
FIG. 2 shows a front view in perspective of the FIG. 1 packet of cigarettes in an open configuration.
Figure 1:
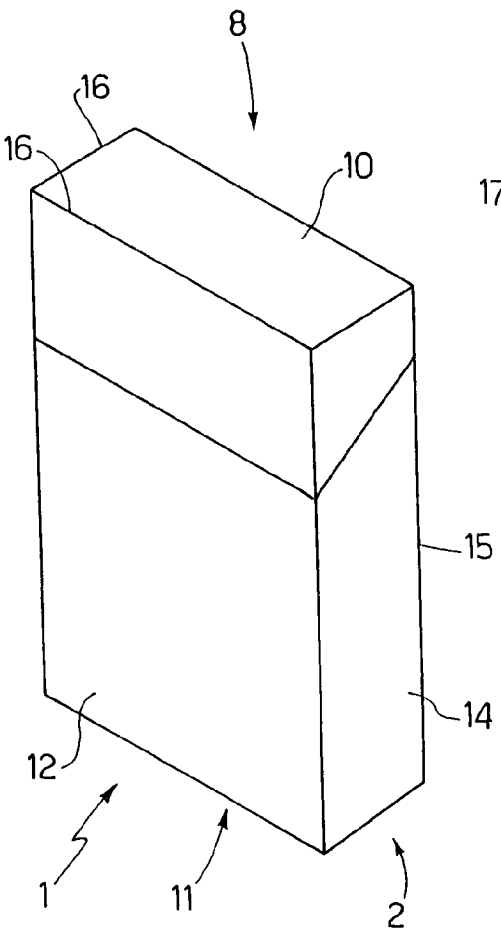
FIG. 1 shows a front view in perspective of a packet of cigarettes in accordance with the present invention and in a closed configuration.
Figure 4:
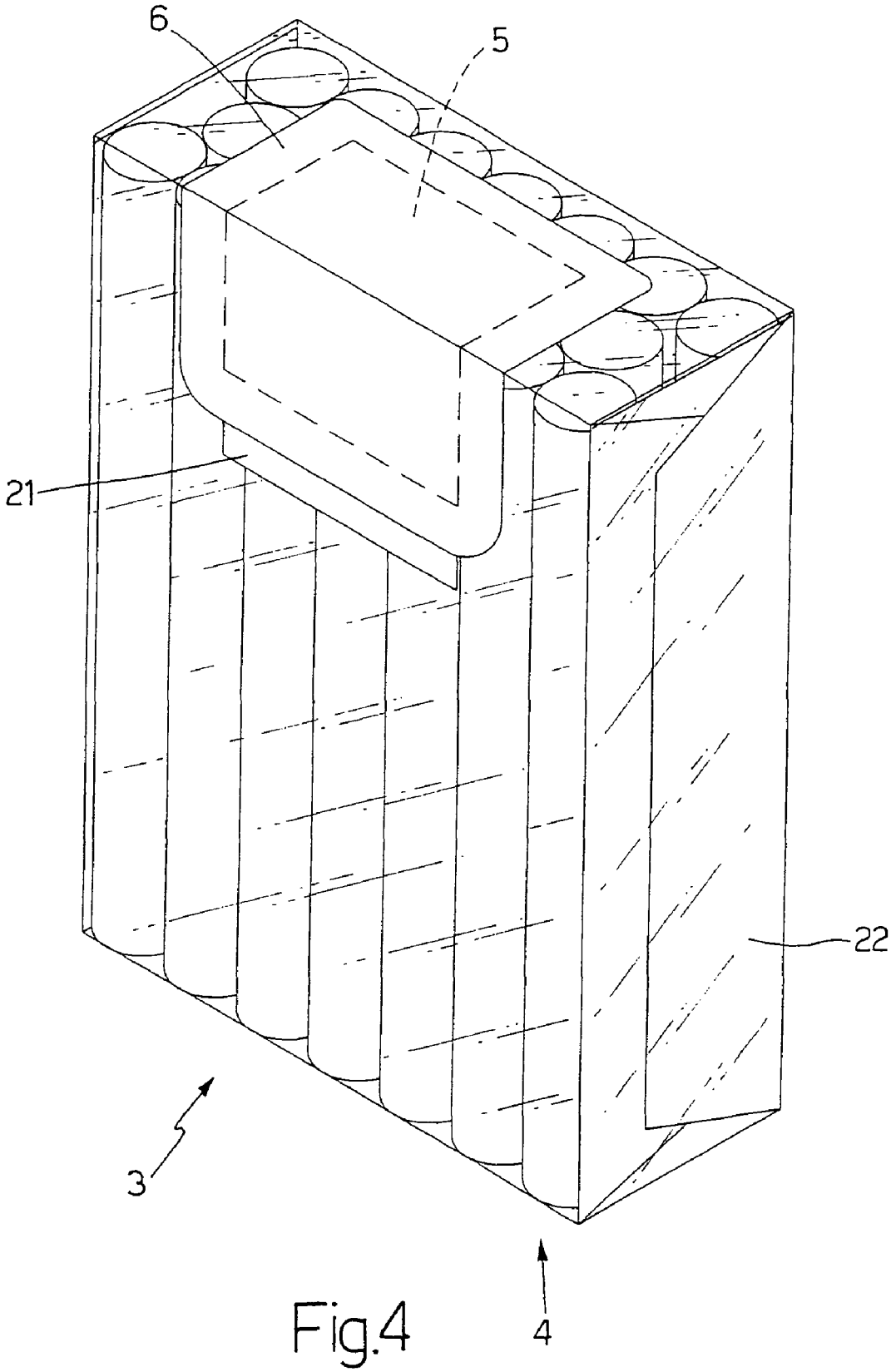
FIG. 4 shows a front view in perspective of an inner package of the FIG. 1 packet.

Number 1 in FIGS. 1, 2 and 3 indicates as a whole a rigid packet of cigarettes comprising a cup-shaped outer container 2 made of rigid cardboard; and an inner package 3 housed inside container 2. Package 3 houses a parallelepiped-shaped group 4 of cigarettes, and has, at the top and front, a central cigarette extraction opening 5 closed by reusable cover flap 6 and extending over a portion of a front wall of package 3, and a portion of a top wall of package 3.

Outer container 2 has an open top end 7, and a cup-shaped lid 8 hinged to container 2 along a hinge 9 to rotate, with respect to container 2, between an open position (FIG. 2) and a closed position (FIGS. 1 and 3) opening and closing open top end 7 respectively.

When lid 8 is in the closed position, outer container 2 is in the form of a rectangular parallelepiped comprising a top wall 10 and a bottom wall 11 opposite and parallel to each other; two opposite parallel major lateral walls 12 and 13; and two opposite parallel minor lateral walls 14. More specifically, one major lateral wall 12 defines a front wall 12 of outer container 2, and the other major lateral wall 13 defines a rear wall 13 of outer container 2. Four longitudinal edges 15 are defined between lateral walls 14 and front and rear walls 12, 13; and eight transverse edges 16 are defined between top and bottom walls 10, 11 and front, rear, and lateral walls 12, 13, 14.

Packet 1 also comprises a collar 17, which is folded into a U and fixed (normally glued) inside outer container 2, so as to project partly outwards of open top end 7 and engage a corresponding inner surface of lid 8 when lid 8 is in the closed position. Collar 17 is made of rigid cardboard, and comprises a front wall 18 contacting front wall 12 of outer container 2; and two lateral walls 19 located on opposite sides of front wall and contacting minor lateral walls 14 of outer container 2.

In a preferred embodiment, collar 17 has two lateral projections 20, which engage the lateral walls of lid 8 interferentially to hold lid 8 in the closed position.

In a preferred embodiment, cover flap 6 is fixed to package 3 using non-dry, re-stick adhesive which is applied to the underside surface of cover flap 6 and extends about the whole of extraction opening 5, so cover flap 6 can be repeatedly detached partly from package 3 (i.e. each time packet 1 of cigarettes is opened) and then fixed back onto package 3. Cover flap 6 preferably has a bottom grip tab 21, by which to grip and lift up cover flap 6, and which has no re-stick adhesive and rests on front wall 18 of collar 17. In other words, to lift up cover flap 6, the user simply grips grip tab 21, which is in no way fixed to front wall 18 of collar 17.

In a different embodiment not shown, package 3 has no extraction opening 5 and no cover flap 6, and has a removable top portion separated from the rest of package 3 by a tear line, and which is torn off when package 3 is unsealed. Preferably, package 3 has a tear strip by which to tear open package 3 along the tear line.

As shown in FIGS. 1-5, package 3 is formed by folding a rectangular sheet 22 of packing material, which is made of transparent, airtight, heat-seal plastic material (typically polypropylene), and is folded directly about group 4 of cigarettes and in direct contact with the cigarettes. Once sheet 22 of packing material is folded about group 4 of cigarettes to form package 3, the form of package 3 is stabilized by heat sealing the superimposed portions of sheet 22 of packing material.

Before being folded about group 4 of cigarettes, sheet 22 of packing material is cut to define extraction opening 5; and cover flap 6, gummed on the underside, is then applied to sheet 22 of packing material. That is, the underside surface of the cover flap is coated with re-stick adhesive which, inside extraction opening 5, glues the inner portion of sheet 22 of packing material permanently to cover flap 6, and, outside extraction opening 5, glues sheet 22 of packing material detachably to cover flap 6.

Figure 5:
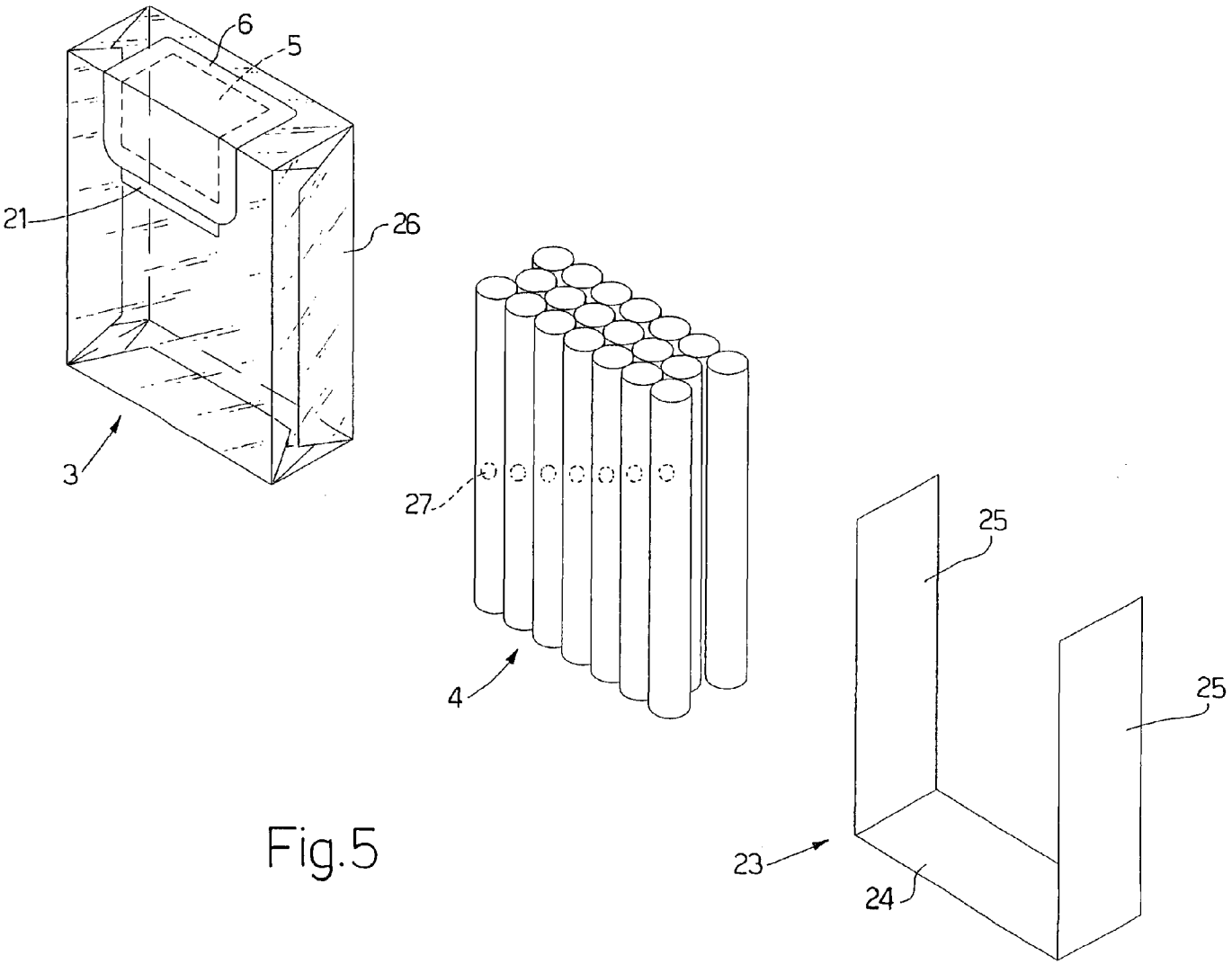
FIG. 5 shows an exploded view in perspective of the FIG. 4 inner package.

As shown in FIG. 5, package 3 comprises a U-shaped stiffener 23 made of rigid cardboard (identical to that of outer container 2 and collar 17) and which is inserted inside package 3, in contact with group 4 of cigarettes. Stiffener 23 comprises a rectangular bottom wall 24 positioned contacting a bottom wall of group 4 of cigarettes defined by the tips of the cigarettes; and two lateral tabs 25 connected to the short sides of bottom wall 24 and positioned contacting the minor lateral walls of group 4 of cigarettes defined by the cylindrical lateral walls of the cigarettes.

In a variation not shown, each lateral tab 25 of stiffener 23 may also have a top appendix which is folded onto the top wall of group 4 of cigarettes.

In a further embodiment not shown, each lateral tab of stiffener 23 may comprise two lateral portions foldable along at least two respective longitudinal fold lines to adapt to the shape of longitudinal edges 15 of outer container 2 when longitudinal edges 15 are non-square and bevelled (as described in Patent EP0204933B1), rounded (as described in Patent EP0205766B1), or "pillow" shaped (as described in Patent Application WO0043289A1). When longitudinal edges 15 of outer container 2 are bevelled, each lateral portion is foldable along one longitudinal fold line; and, when the longitudinal edges of outer container 2 are rounded or "pillow" shaped, each lateral portion is foldable along a number of parallel, closely spaced longitudinal fold lines.

Stiffener 23 provides for stiffening and maintaining the shape of package 3, to prevent the partly filled package 3 from collapsing and so making it difficult to withdraw the remaining cigarettes and, in particular, to open and close cover flap 6. A further function of stiffener 23 is to provide adequate mechanical protection of the cigarettes when folding sheet 22 of packing material, adequate mechanical and thermal protection of the cigarettes when heat sealing the superimposed portions of sheet 22 of packing material, and adequate mechanical protection of the cigarettes when handling package 3.

Figure 6:
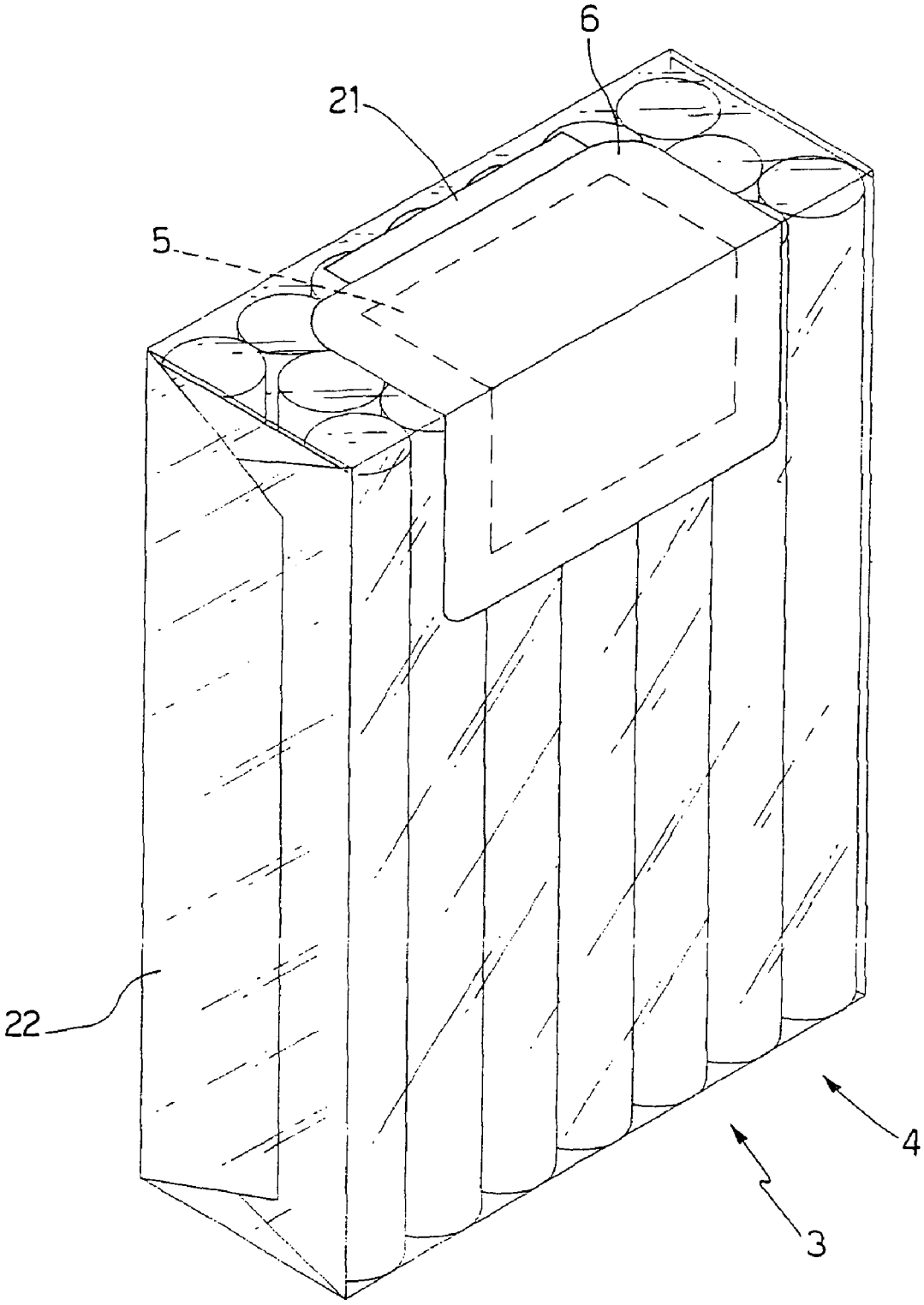
FIG. 6 shows a different embodiment of the FIG. 4 inner package.
Figure 7:
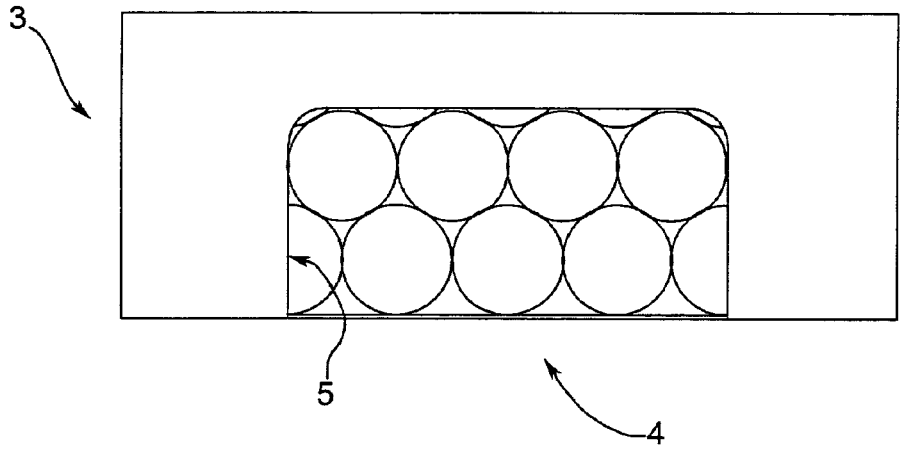
FIG. 7 shows a top plan view of a further embodiment of the FIG. 4 inner package.
Figure 8:
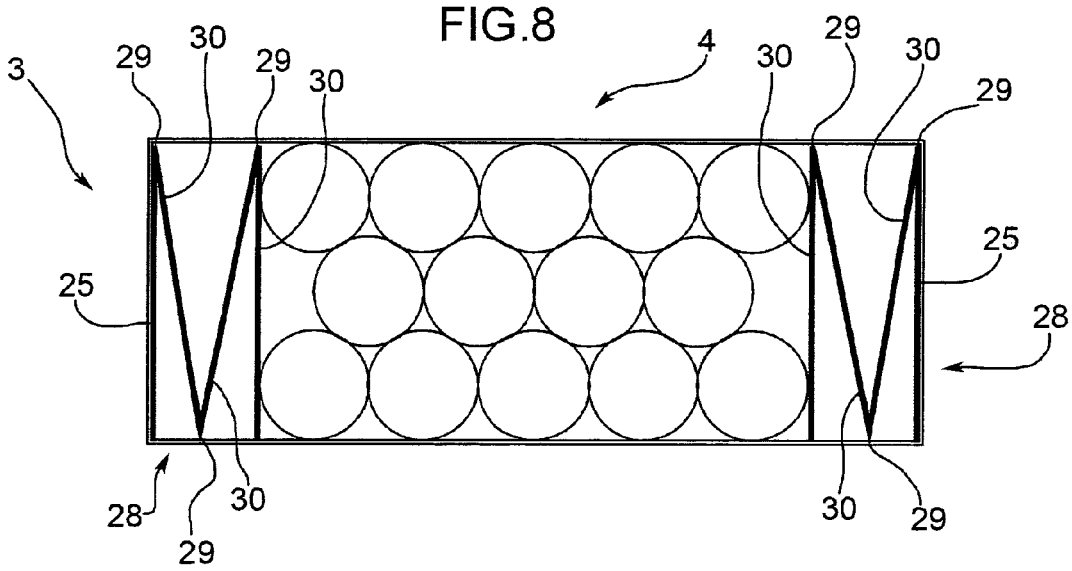
FIG. 8 shows a cross section of the FIG. 7 inner package.
Figure 9:
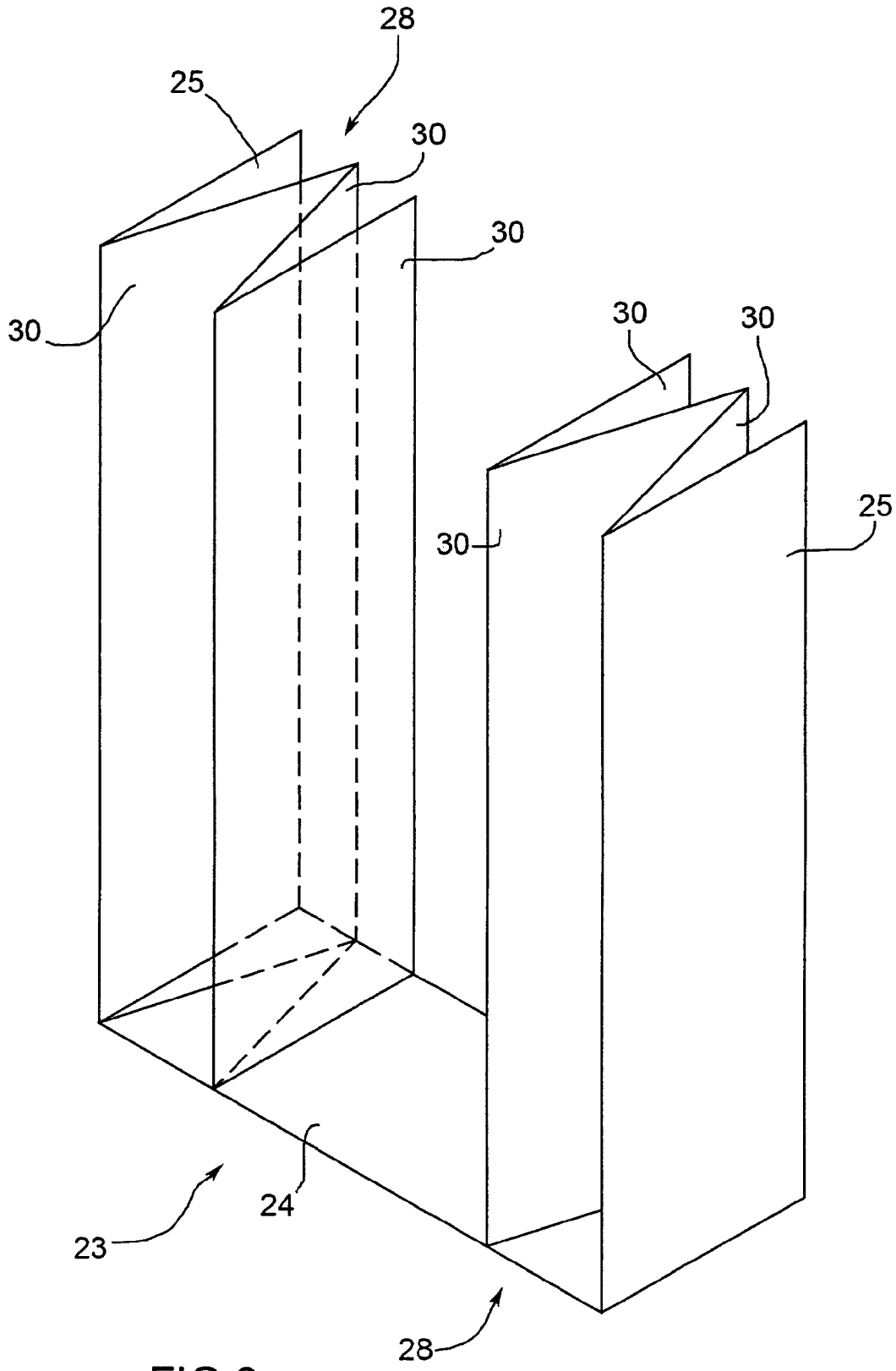
FIG. 9 shows a view in perspective of a stiffener of the FIG. 7 inner package.
Figure 10:
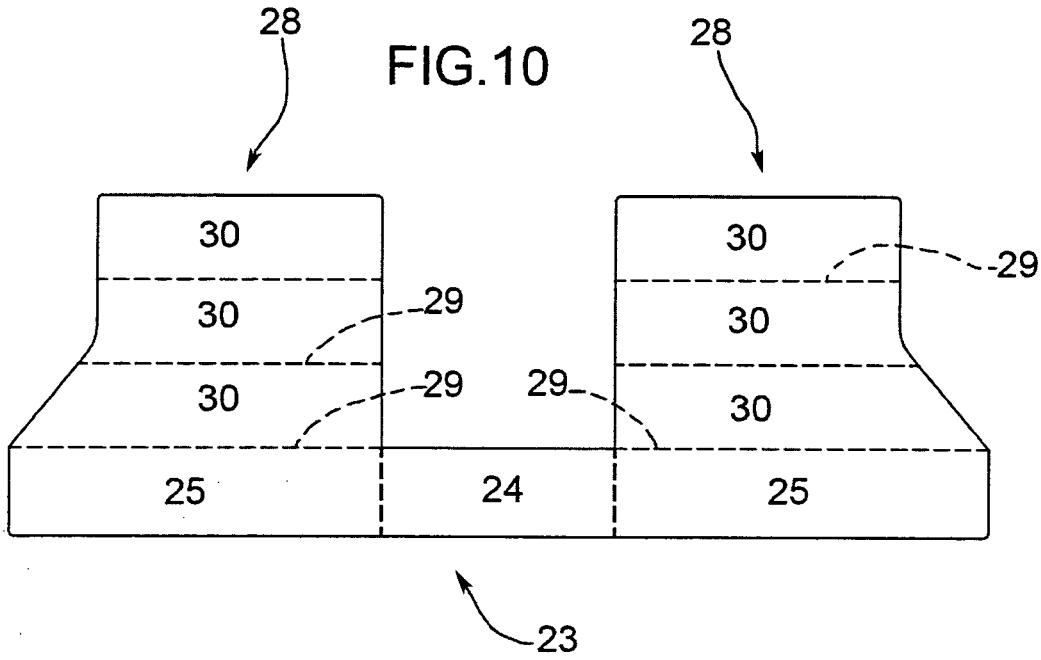
FIG. 10 shows a spread-out view of a stiffener of the FIG. 7 inner package.
Figure 12:
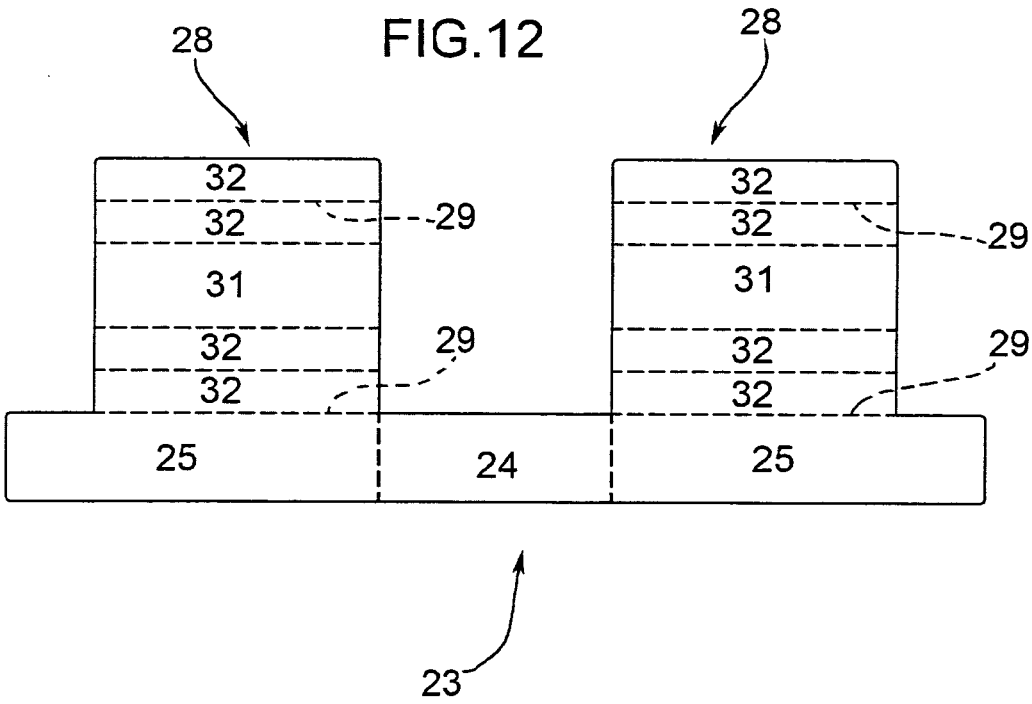
FIG. 12 shows a spread-out view of a stiffener of the FIG. 11 inner package.
Figure 11:
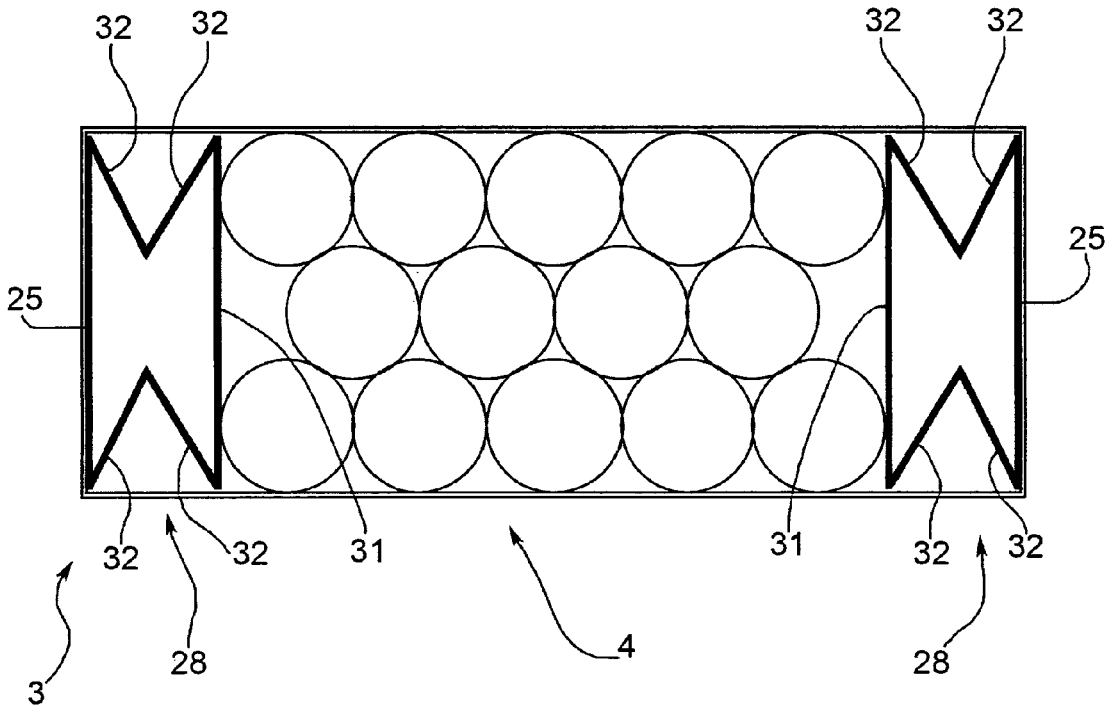
FIG. 11 shows a cross section of a variation of the FIG. 7 inner package.

In the FIG. 1-5 embodiment, cover flap 6 extraction opening 5 is positioned with grip tab 21 on the front wall of package 3, and is therefore opened upwards (i.e. from the front wall to the top wall of package 3), and a top portion of cover flap 6 remains in contact with the top wall of package 3. In the FIG. 6 variation, cover flap 6 of extraction opening 5 is positioned with grip tab 21 on the top wall of package 3, and is therefore opened downwards (i.e. from the top wall to the front wall of package 3), and a bottom portion of cover flap 6 remains in contact with the front wall of package 3. For easy grip, part or all of grip tab 21 may project from the top wall towards the rear wall of package 3.

In one possible embodiment shown in FIG. 3, outer container 2 of packet 1 of cigarettes has at least one through window 26, through which package 3 underneath, and, since package 3 is transparent, also the cigarettes in group 4 are visible. As shown in FIG. 3, window 26 is formed through rear wall 13 (not engaged by collar 17) of outer container 2.

Alternatively, window 26 may be formed through front wall 12 (in the portion not engaged by collar 17) of outer container 2. Window 26 may also be closed internally by a sheet of transparent plastic material fixed to an inner surface of outer container 2 about window 26.

In a further embodiment shown by dash lines in FIG. 5, the outward-facing surface of at least one cigarette contacting package 3 is printed with a graphic (e.g. a logo, writing, a drawing, a letter forming writing with the other letters printed on the adjacent cigarettes) which, package 3 being transparent, is visible from outside package 3. In a preferred embodiment, graphic 27 (or graphics 27 as a whole) is located at window 26 through outer container 2, so as to be visible from outside outer container 2 (i.e. from outside packet 1 of cigarettes).

Since extraction opening 5 only covers a central portion of package 3, the lateral cigarettes are inevitably concealed and, during normal use of packet 1 of cigarettes, may be difficult to withdraw, especially when package 3 is "drawn tight", i.e. wrapped about group 4 of cigarettes with substantially no clearance. To simplify withdrawal of the lateral cigarettes, modified stiffener 23 has been proposed, as shown in the FIG. 7-12 embodiment.

As shown in FIGS. 7-12, two elastic bodies 28 are located inside and on opposite sides of package 3 to exert elastic thrust on and so keep group 4 of cigarettes in a central position facing extraction opening 5. In other words, group 4 of cigarettes is flanked on opposite sides with two elastic bodies 28, which are initially fully compressed, and expand gradually, as the cigarettes are withdrawn through extraction opening 5, to keep the rest of group 4 of cigarettes in a central position facing extraction opening 5.

In a preferred embodiment, the two elastic bodies are supported by stiffener 23. More specifically, each elastic body 28 comprises a sheet of cardboard, which is at least partly folded accordion-fashion and fixed to a lateral tab 25 of stiffener 23 along at least one longitudinal fold line 29.

In the FIG. 7-10 embodiment, each elastic body 28 comprises three panels 30 folded accordion-fashion about respective longitudinal fold lines 29. In a variation, each elastic body 28 may obviously comprise a different number (e.g. one, two, four or five) panels 30 folded accordion-fashion. In the FIGS. 11 and 12 embodiment, each elastic body 28 comprises a central panel 31; and two groups of lateral panels 32, in each of which the lateral panels 32 are folded accordion-fashion about respective longitudinal fold lines 29. Preferably, each group of lateral panels 32 comprises two lateral panels folded accordion-fashion about respective longitudinal fold lines 29.

In a preferred embodiment, elastic bodies 28 (i.e. panels 30, 31, 32) are shorter in height, i.e. longitudinally, than package 3, so as to be located a given distance from extraction opening 5, so that, close to extraction opening 5, the lateral sides of group 4 of cigarettes are clear (i.e. not engaged by elastic bodies 28) to permit easy withdrawal of a cigarette from group 4 by the user.

By virtue of elastic bodies 28, group 4 of cigarettes, even when almost fully consumed, is maintained in a central position facing extraction opening 5; thus enabling fast, easy withdrawal of the cigarettes through extraction opening 5, despite this only covering a central portion of package 3.

It is important to note that, given their advantages, elastic bodies 28 may be used in conjunction with any type of package 3 with a central extraction opening 5, regardless of whether package 3 is made of transparent plastic material, as described above, or non-transparent plastic (typically grey foil) material.

Moreover, in the embodiment shown in the drawings, package 3 described forms part of a rigid packet 1 of cigarettes comprising an outer container 2 housing package 3. In a different embodiment not shown, package 3 described may form part of a soft packet of cigarettes comprising an outer package partly enclosing package 3 (leaving the top wall free). In a further embodiment, package 3 described may constitute a package of cigarettes; in which case, the outer surface of sheet 22 of transparent packing material may be printed (with information required by law, logos, designs, trademarks, etc.).

Package 3 described has numerous advantages. In particular, it is cheap and easy to produce, by virtue of stiffener 23 being easy to fold, even on a standard packing machine. As a result, packet 1 of cigarettes described (housing package 3) can be produced on a standard packing machine, as opposed to requiring a special-purpose machine.

Moreover, being extremely thin and flexible, sheet 22 of packing material is able to faithfully reproduce the outer contour of group 4 of cigarettes (i.e. is able to form square edges), thus resulting in a "square" finished package 3 which is more popular with consumers.

The invention claimed is:

1. A package of cigarettes comprising:

a group (4) of cigarettes;

an inner package (3) enclosing the group (4) of cigarettes and having a central cigarette extraction opening (5);

two elastic bodies (28) located inside the inner package (3), on opposite sides of the inner package (3), to exert elastic thrust on the group (4) of cigarettes and so keep the group (4) of cigarettes in a central position facing the extraction opening (5); and a U-shaped stiffener (23) which is made of rigid material, is located inside the inner package (3), contacting the group (4) of cigarettes, and comprises a bottom wall (24) positioned contacting a bottom wall of the group (4) of cigarettes, and two lateral tabs (25) connected to the short sides of the bottom wall (24), positioned contacting the minor lateral walls of the group (4) of cigarettes and supporting the two elastic bodies (28) exerting elastic thrust on the group (4) of cigarettes.

2. The package as claimed in claim 1, wherein the cigarette extraction opening (5) extends over a limited portion of a front wall of the inner package (3), and a limited portion of a top wall of the inner package (3).

3. The package as claimed in claim 1, wherein each lateral tab (25) of the stiffener (23) has a top appendix which is folded onto a top wall of the group (4) of cigarettes.

4. The package as claimed in claim 1, wherein each lateral tab (25) of the stiffener (23) comprises two lateral portions foldable along at least two respective longitudinal fold lines.

5. The package as claimed in claim 1, wherein each elastic body (28) is integral with a respective lateral tab (25) of the stiffener (23).

6. The package as claimed in claim 1, wherein each elastic body (28) is defined by a sheet of cardboard at least partly folded accordion-fashion.

7. The package as claimed in claim 6, wherein each elastic body (28) comprises a number of panels (30) folded accordion-fashion.

8. The package as claimed in claim 7, wherein each elastic body (28) comprises three panels (30) folded accordion-fashion about respective longitudinal fold lines (29).

9. The package as claimed in claim 6, wherein each elastic body (28) comprises a central panel (31), and two groups of lateral panels (32);

the lateral panels (32) in each group of lateral panels (32) being folded accordion-fashion.

10. The package as claimed in claim 9, wherein each group of lateral panels (32) comprises two lateral panels (32) folded accordion-fashion about respective longitudinal fold lines (29).

11. The package as claimed in claim 1, wherein the elastic bodies (28) are shorter in height than the inner package (3), so as to be located a given distance from the extraction opening (5).

12. The package as claimed in claim 1, wherein the central cigarette extraction opening (5) is closed by a cover flap (6).

13. The package as claimed in claim 12, wherein the cover flap (6) is reusable and fixed to the inner package (3) by non-dry, re-stick adhesive.

14. The package as claimed in claim 1 and comprising:

a rigid outer container (2), which houses the inner package (3), is cup-shaped, and has an open top end (7); and a cup-shaped lid (8) hinged to the outer container (2) along a hinge (9) to rotate, with respect to the outer container (2), between an open position and a closed position opening and closing the open top end (7) respectively.

15. The package as claimed in claim 1, wherein each lateral tabs (25) of the stiffener (23) permanently contacts a lateral wall of the inner package (3) and supports a respective elastic body (28) exerting elastic thrust on the group (4) of cigarettes.

16. The package as claimed in claim 15, wherein each elastic body (28) is integral with a respective lateral (25) of the stiffener (23).

17. The package as claimed in claim 16, wherein each elastic body (28) is defined by a sheet of cardboard at least partly folded accordion-fashion.

18. The package as claimed in claim 17, wherein each elastic body (28) comprises a number of panels (30) folded accordion-fashion.

* * * * *